United States Patent [19]

Fleissner

[11] Patent Number: 4,970,879

[45] Date of Patent: Nov. 20, 1990

[54] APPARATUS FOR FLOW-THROUGH TREATMENT OF TEXTILE MATERIAL, PAPER, OR THE LIKE

[75] Inventor: Gerold Fleissner, Chur, Switzerland

[73] Assignee: Fleissner Maschinenfabrik AG, Rebstein, Switzerland

[21] Appl. No.: 485,052

[22] Filed: Feb. 26, 1990

Related U.S. Application Data

[63] Continuation-in-part of Ser. No. 355,357, May 23, 1989, Pat. No. 4,912,945.

[30] Foreign Application Priority Data

Mar. 24, 1989 [DE] Fed. Rep. of Germany ..... 3905738

[51] Int. Cl.[5] ..... D06B 5/08

[52] U.S. Cl. ..... 68/5 D; 34/123; 68/158; 68/903

[58] Field of Search ..... 68/903, 5 D, 5 E, 158, 68/184; 34/111, 122, 123, 139

[56] References Cited

U.S. PATENT DOCUMENTS 3,276,140 10/1966 Walser et al. ..... 34/122 X
3,303,576 2/1967 Sisson ..... 34/122 X
3,752,639 8/1973 Thagarg, Jr. ..... 34/122 X
3,955,226 5/1976 Feess et al. ..... 68/903 X

FOREIGN PATENT DOCUMENTS 1460525 11/1970 Fed. Rep. of Germany ..... 68/903

*Primary Examiner*—Philip R. Coe
*Attorney, Agent, or Firm*—Antonelli, Terry, Stout & Kraus

[57] ABSTRACT

A highly permeable drum for the wet or dry treatment of textile material, paper or other permeable materials of a certain width has an outer shell comprising narrow sheet metal strips and narrow webs, the extension in width of which is oriented in the radial direction. The sheet metal strips extend axially parallel. According to the further development of this basic structure, the sheet metal strips each consist of at least two strips of half thickness arranged proximate to each other. The juxtaposed sheet metal strips are arranged radially offset with respect to one another so that, at an outer periphery, only half of the total thickness of a sheet metal strip is provided, which arrangement substantially increases the air permeability of the drum.

3 Claims, 1 Drawing Sheet

APPARATUS FOR FLOW-THROUGH TREATMENT OF TEXTILE MATERIAL, PAPER, OR THE LIKE

CROSS-REFERENCE TO RELATED APPLICATION

This application is a continuation-in-part of application Ser. No. 07/355,357, filed May 23, 1989, and now Pat. No. 4,912,945.

BACKGROUND OF THE INVENTION

This invention relates to an apparatus for the flow-through treatment of textile material, nonwovens, or paper, with a gaseous or liquid treatment medium circulated in the entire apparatus. The apparatus comprises a permeable drum as a conveying element subjected to throughflow from the outside toward the inside, the drum being under a suction draft and having end plates at the end faces, and being covered on its periphery with a screen-type cover, sheet metal strips extending in the axial direction of the drum being arranged between the end plates of the drum, the extension in width of these sheet metal strips running substantially in the radial direction, and connecting elements which connect the sheet metal strips being provided in the peripheral direction between the sheet metal strips.

An apparatus of this type has been known from German Patent No. 1,946,376. The connecting elements consist of spacers associated with each sheet metal strip, these spacers being of a U shape and being welded to the sheet metal strips with their rear side. A more advantageous structure is disclosed in German Patent Application No. P 38 02 791.7 and corresponding U.S. Pat. No. 4,811,574. In this structure, these connecting elements are replaced by readily mountable spacers joined to the sheet metal strips by screws or rivets. Since these connecting elements taper radially outwardly into a web section, the maximum width of which is equal to the sheet metal thickness of the axially extending sheet metal strips, this sieve drum structure provides an optimum permeability of up to 90% for traversing fluid. The maximum permeability is attained where the strength of the sieve drum has reached its still permissible minimum. The strength is determined by the wall thickness of the axially extending sheet metal strips and, of course, also by the wall thickness of the connecting elements.

SUMMARY OF THE INVENTION

This invention is based on the object of finding a construction wherein the permeability can be still further increased past the 90% value. For this purpose, it was proposed to fashion the radially outwardly located ends of the sheet metal strips and/or of the webs of the connecting elements to be rounded or pointed, in order to have the sieve screen rest only on these rounded or pointed ends of the supporting elements. However, this idea had to fail because the drum, after assembly, had to be additionally treated on the outside to obtain exact true running accuracy. This treatment can be effected either by grinding or turning of the outside diameter, but the extent of cutting and machining treatment is greater than the height of the rounded webs or the sheet metal strips machined to a point.

Starting with the apparatus of the type heretofore described, the invention provides, to solve the thusposed problem, that the sheet metal strips in each case consist of at least two individual sheet metal strips arranged in parallel to each other and disposed radially offset with respect to each other in such a way that the peripheral contour of the drum is constituted only by the outer edge of one of the two proximate sheet metal strips and thus the screen-type cover of the sieve drum is respectively supported only by the outer edge of the radially outwardly projecting sheet metal strip. In this way, the air permeability of the drum is once again increased in that the flow resistance of the sheet metal strips is halved without reducing the strength of the drum. It will be appreciated that the essential aspect in determining the air permeability attainable is solely the supporting area of the radially outwardly projecting drum elements, namely, the area of the sheet metal strips and of the connecting elements, rather than the cross section that exists radially further inwardly away from the outer periphery. Thus, the thinner these radially outwardly projecting drum sections, the better the air permeability. A value of more than 95% is attainable by means of the arrangement according to this invention.

BRIEF DESCRIPTION OF THE DRAWINGS

The accompanying drawings show one embodiment of the apparatus according to this invention in which.

DETAILED DESCRIPTION OF THE INVENTION

Figure 1:
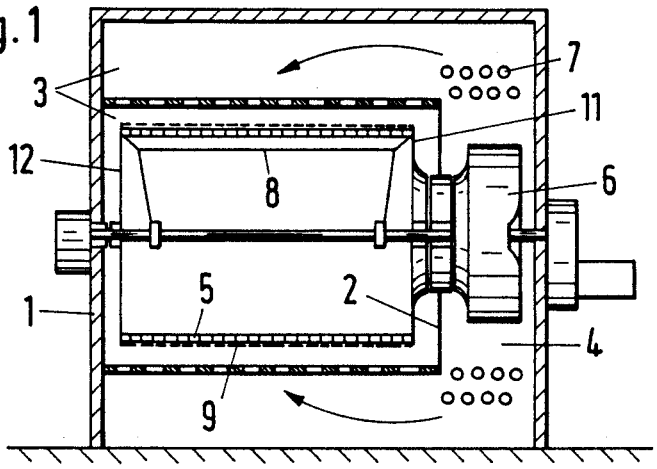
FIG. 1 is a longitudinal section through a sieve drum drying device, wherein, the drum shell is made from a sheet metal strip structure.

The sieve drum device according to FIG. 1 consists of a rectangular housing 1 subdivided by a partition 2 into a treatment chamber 3 and a fan chamber 4. In the treatment chamber 3, a sieve drum 5 is rotatably supported, and, concentrically thereto, a fan 6 is rotatably mounted in the fan chamber 4. The fan chamber can, of course, also be arranged in a segregated, separate fan housing, not shown herein. In any event, the fan places the interior of the sieve drum 5 under a suction draft by way of its open end face. (This invention likewise covers the drum construction in connection with a wet treatment device which can also serve merely for suction removal of liquid. The total construction then must be adapted correspondingly).

According to FIG. 1, heating units 7 are, respectively, located above and below the fan 6; these heating units consist of pipes traversed by a heating medium. In general, the sieve drums of the structure here only of interest, which structure is to be air-permeable, are built with a very large diameter, and the sieve drum is covered during the heat treatment with the textile material or paper to be treated over almost the entire peripheral surface area. In the some of the deposition and removal of the textile material, however, the drum is to be shielded from the inside against the inwardly prevailing suction draft; for this reason, FIG. 1 shows an inner protective cover 8. However, the cover, in this embodiment, could also be fixedly mounted at the level of the drum axis. On the outside, a fine-mesh screen 9 is wrapped around the sieve drum shell and is attached at the end faces of the drum to the two end plates 11, 12.

Figure 2:
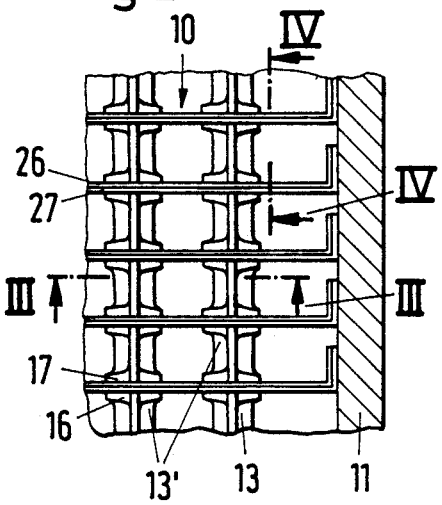
FIG. 2 is an enlarged plan view of the sheet metal strip structure of the drum shell with interposed connecting elements.
Figure 3:
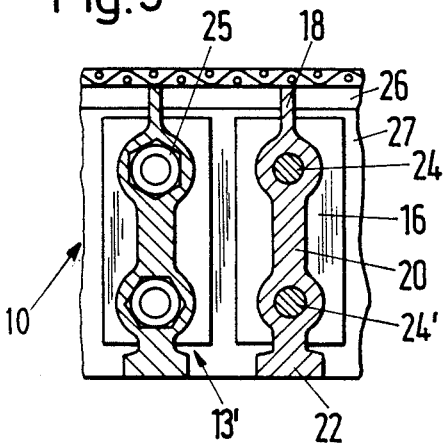
FIG. 3 is, in an enlarged view, a section taken along line III—III according to FIG. 2.
Figure 4:
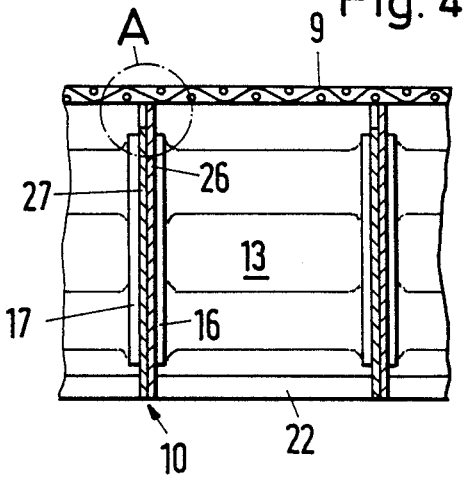
FIG. 4 is a section taken along line IV—IV, likewise according to FIG. 2, showing a detail A.
Figure 4A:
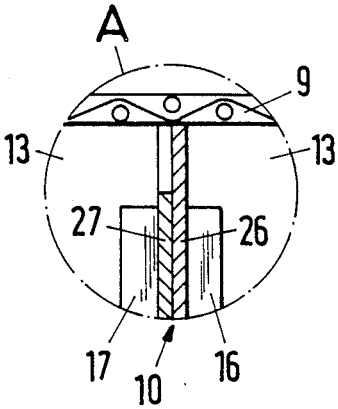

The drum shell structure comprises axially aligned sheet metal strips 10, their extension in width can be seen from FIGS. 3 and 4 and runs in the radial direction. Therefore, the screen-type cover 9 rests basically only on the edges of the sheet metal strips 10 that are arranged radially on the outside and the edges of connecting elements 13; these edges will be described in greater detail hereinafter in connection with FIG. 3 and FIG. 4. The sheet metal strips 10 are attached at defined spacings side-by-side to the two end plates 11, 12, by means of screws or rivets (not shown). In order to maintain this spacing over the width of the sieve drum 5, connecting elements denoted by reference numerals 13, 13' in their entirety are provided which serve as spacers and are joined by means of screws 24 to the sheet metal strips 10. The connecting elements 13, 13' have an approximate double-T configuration according to FIG. 2. This cross section results from the necessarily firm contact of the connecting elements 13, 13' with the sheet metal strips 10 and ensues a more rugged and more torsion-resistant total structure of the sieve drum. The connecting elements, however, are not designed with flanges 16, 17 over their entire height, but only in the zone of the screws 24 penetrating these connecting elements, as can be seen from FIGS. 3 and 4. The radially outwardly located regions or portions of the connecting elements each consist merely of the narrow web 18 on which then rests additionally —the element being joined to the sheet metal strips 10—the screen-type cover 9. (Structure of each connecting element is shown in greater detail in U.S. Pat. 4,811,574).

FIG. 3 shows the radial cross section of the connecting elements 13. The cross section of double-T shape according to FIG. 2 can be recognized in FIG. 3 from the rectangular flange 16. The connecting element 13 is, in total, fashioned to be very thin, namely only solid enough to attain the required strength and to provide adequate hold for the screws 24, 24' extending through the connecting element 13. The thickness of the material in the zone of the screen-type cover 9 is extremely thin on account of the web 18.

A screw assembly consists normally of a threaded shaft having an integrated screwhead at one end and, on the other end, a screw nut. The specific nuts 25 of this structure are as long as a connecting element 13, thus completely replacing such an element, at least with respect to spacing. It is advantageous for the screw ends of a threaded shaft to contact each other within the respective nut 25. It is especially advantageous for the nuts 25 to be encompassed by connecting element 13' as can be seen from FIG. 3.

FIG. 4, showing an enlarged illustration of detail A, depicts the configuration of the sheet metal strips 10. Each sheet metal strip 10 consists, in this embodiment according to the invention, of two individual sheet metal strips 26, 27 disposed proximately and radially offset with respect to each other in such a way that the peripheral contour of the sieve drum 5 is constituted only by an outer edge of one of the two proximate sheet metal strips —denoted by 26 in the drawing —and thus, according to detail A, the screen-type cover 9 rests, in each case, solely on the outer edge of the radially outwardly projecting sheet metal strip 26. Thus, without affecting the strength of the total drum structure, the supporting surface area of the screen-type cover 9 with respect to the sheet metal strips 10 is cut in half.

It is expedient to fashion the sheet metal strips 26, 27 of differing widths so that the radially inner diameter is the same for both sheet metal strips 26, 27. It can also be seen from FIG. 4 that the radially inner diameter for both sheet metal strips 26, 27 terminates at the level of the inner diameter of the base 22 of the connecting element 13. As a result, the radially inner surface area of the drum shell structure is fashioned to be wider for effecting a seal by means of the inner covering 8.

What is claimed:

1. An apparatus for the flow-through treatment of textile material, nonwovens, or paper, with a gaseous or liquid treatment medium circulated in the entire apparatus, said apparatus comprising a permeable drum as a conveying element subject to throughflow from the outside toward the inside, said drum being under a suction draft and having end plates at the end faces, and being covered on its periphery with a screen-type cover, sheet metal strips extending in the axial direction and being arranged between the end plates of the drum, an extension in width of these sheet metal strips running substantially in the radial direction, and connecting elements which connect the sheet metal strips being provided in the peripheral direction between the sheet metal strips; each of said axially extending strips comprising two individual sheet metal strips disposed radially offset with respect to one another in such a way that a peripheral contour of the drum provided by the metal strips is constituted solely by an outer edge of one of the two proximate individual sheet metal strips and consequently the screen-type cover is in each instance supported by the outer edge of the one radially outwardly projecting sheet metal strip.

2. An apparatus according to claim 1, wherein the individual sheet metal strips for a single axial extending sheet metal strip are made to be of differing widths and arranged juxtaposed to each other so that a radially inner diameter for both individual sheet metal strips is identical.

3. An apparatus according to claim 2, wherein the radially inner diameter for both sheet metal strips is located at the level of an inner diameter of a base of an associated connecting element.

* * * * *